United States Patent [19]

Swartwout

[11] 4,290,575

[45] Sep. 22, 1981

[54] INTEGRAL CLIP AND HANGER

[76] Inventor: Everett W. Swartwout, 11 St. Andrews Way, South Yarmouth, Mass. 02664

[21] Appl. No.: 60,483

[22] Filed: Jul. 25, 1979

[51] Int. Cl.[3] ..... A47F 5/00

[52] U.S. Cl. ..... 248/316 D; 24/252 R; 211/89

[58] Field of Search ..... 248/205 A, 316 D, 226.2, 248/226.5, 74 A; 24/73 R, 73 CH, 73 AS, 73 B, 73 PF, 81 DS, 255 R, 259 R, 252 R; 211/89

[56] References Cited

U.S. PATENT DOCUMENTS

| | | | |
|---|---|---|---|
| 2,762,100 | 9/1956 | Wallney | 24/259 R X |
| 3,135,034 | 6/1964 | Fauteux | 24/252 R X |
| 3,279,479 | 10/1966 | Solomon | 24/252 R X |
| 3,309,052 | 3/1967 | Borisof | 248/316 D X |
| 3,579,751 | 5/1971 | Jonckheere | 24/252 R |

*Primary Examiner*—J. Franklin Foss

*Attorney, Agent, or Firm*—Cesari & McKenna

[57] ABSTRACT

An integral clip and hanger including a pair of opposing jaws supported by support means pivotally coupled together, and further including a member for biassing the jaws together. The biassing member includes an elongated member pivotally attached to one of the support members and adapted to be disposed between the support means in a U-shaped curve to resiliently bias the jaws together. Two hooks are provided, one being attached to one of the support means, and another being between the support means.

9 Claims, 4 Drawing Figures

INTEGRAL CLIP AND HANGER

BACKGROUND OF THE INVENTION

1. Field of the Invention

This invention relates generally to the field of clips or clamps, and more particularly to clips which have an integral biasing member.

2. Description of the Prior Art

In the prior art clips normally have included a pair of arms pivotally disposed with respect to each other and supporting a pair of opposing jaws at one end. The arms of such clips are biased relative to each other with the jaws either open or closed, and require the user to overcome the biasing force to use the clip. Know clips usually require two or more separate components which must be assembled to produce the clip. For example, in many prior art clips, the hinge pivot must be inserted into the respective arms. And even when the hinge pivot is integral with the arms, the biasing member must be appropriately inserted and seated between the arms to provide the biasing force. In manufacturing such clips, the separate parts must be individually manufactured, matching inventories must be built up of the several parts, and they must be assembled and properly seated to form the clip. The labor incident to obtaining and selecting the proper parts and assembling them may add appreciably to the cost of manufacturing the clips.

In the present invention, the entire clip, including the biasing member, is formed (here, molded) in one piece. This reduces inventory requirements and facilitates a simplified assembly procedure which reduces the labor costs and the possibility of manufacturing error.

A prior patent, U.S. Pat. No. 3,279,479, issued to N. L. Solomon, discloses a one-piece clip including a flexible integral spring finger. In the several embodiments of the clip disclosed in that patent, the spring fingers are shown as extending between the clip's arms near the ends thereof. Because of the structural differences between those clips and the clips of the instant invention, substantially different force distributions are present, placing different stresses on the components. Furthermore, the prior clips are assembled by flexing the finger and urging the free end to properly seat in the receiving arm. This procedure is more complicated than the procedure for assembling the clip disclosed herein, with a consequent increase in the expense of the labor and the chance that a clip may be wrongly assembled. Also, with the spring member oriented as in the above-referenced patent, it is exposed so that there is an increased chance that the finger may be jarred out of its proper seating, or squeezed out of its proper seating if the arms are squeezed together too tight. This is not possible with the clip disclosed herein.

SUMMARY

In brief summary, the invention provides, in an integrally molded assembly, a clip having a base plate which serves as one arm of the clip, and a second arm pivotally attached to the base plate, the second arm and the base plate each having attached one of a pair of opposing jaws. A resilient, elongated member is pivotally attached to the end of the arm distal to its associated jaw. In producing the clip, the elongated member is flexed and urged between the second arm and the plate. When seated, the elongated member has a concave orientation and abuts both the second arm and the plate. The member thus flexed biases the distal ends of the arms apart, forcing the jaws together.

BRIEF DESCRIPTION OF THE DRAWINGS

For a fuller understanding of the nature and objects of the invention, reference should be had to the following detailed description taken in connection with the accompanying drawings, in which.

DESCRIPTION OF AN ILLUSTRATIVE EMBODIMENT

Figure 1:
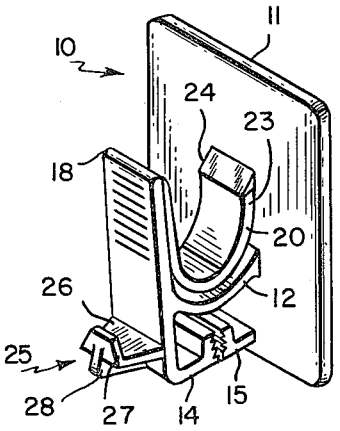
FIG. 1 is an isometric view of a clip according to the invention.
Figure 2:
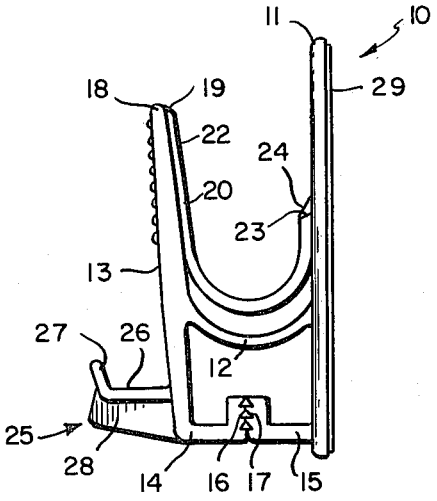
FIG. 2 is a side elevational view of the clip shown in FIG. 1 with the biasing member in the flexed and seated position.

As exemplified in FIGS. 1 and 2, a clip 10 includes a plate 11, a flexible web 12 and an arm 13. The web 12 constitiutes a hinge about which arm 13 and plate 11 can pivot with respect to each other. A pair of jaws 14 and 15 extend towards each other supported by arm 13 and plate 11 respectively. The jaws terminate in a pair of opposing faces 16 and 17, which may be toothed or serrated. Arm 13 is connected at end 18 distal to the jaw 14 to a neck portion 19, which forms a living hinge, and, through neck 19, to an elongated member 20. Member 20 has a relatively thick portion 21 distal to the neck tapering to a thin portion 22 proximate the neck. The thick portion 21 ends in a free end 23. When assembled as shown in FIGS. 1 and 2, member 20 is flexed and seated between plate 11 and arm 13, forming a substantially U-shaped bias element oriented so that the open end of the U is toward the distal ends of the arms, with the legs of the U abutting the respective arms. The clip further includes an embossed stop 24 extending forwardly from plate 11 to retain the free end 23.

Figure 3:
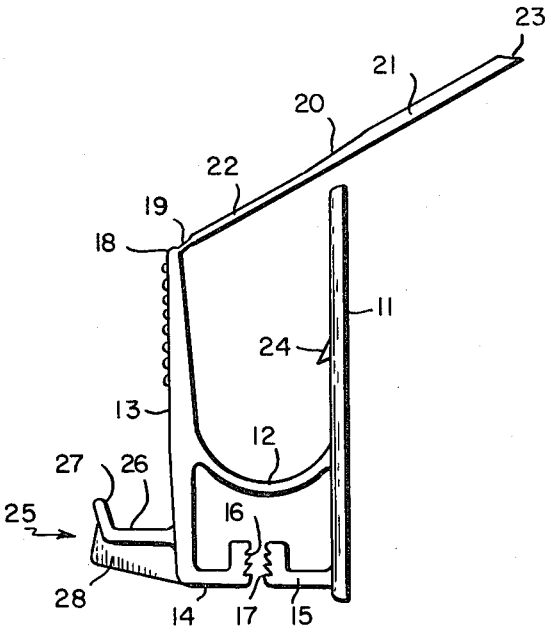
FIG. 3 is a side elevational view of the clip shown in FIG. 1 with the biasing member in the unflexed position, as initially formed.

The clip is preferably plastic and molded in one piece. It may be formed from a relatively hard, resilient material, preferably a memory plastic, which generates a restoring force when flexed. The clip is molded as exemplified in FIG. 3, with the elongated member 20 in a flat shape.

To assemble the clip, the elongated member 20 is pivoted about neck 19, downwardly towards the upper edge of plate 11. After the member 20 abuts plate 11, the member is urged downwardly between arm 13 and plate 11. Member 20 thus acquires a U-shape, concave upwardly as shown in FIGS. 1 and 2. If member 20 has the proper length relative to the other dimensions of the clip, which can be readily determined experimentally, it will retain the U-shape it thus acquires. The free end of member 20 is snapped past stop 24, which insures that it is properly seated and prevents it from slipping upwardly on plate 11 while the clip is being used. The flexed portion of the member between the arm and the plate urges the distal end of the arm away from the plate, thereby biasing the jaws together.

Clip 10 alternatively may be formed without stop 24. If it is desired to not include stop 24 in clip 10, the clip is assembled by first urging the elongated member 20 between plate 11 and arm 13 until it abuts web 12. The distal ends of the arm and plate are then squeezed together to open the jaws of the clip as far as possible.

This sets member 20, and it will retain the U-shape and remain seated between the plate and arm.

The thick portion 21 is preferably long enough to extend from plate 11 to at least abut arm 13. This ensures the sufficient biasing force will be generated by the flexed elongated member, since the biasing force generated by a memory plastic is related to its thickness as well as its length. The thin portion 22 provides a radial arm to connect the thick portion to neck 19. Thin portion 22 may be longer or shorter depending on where the biasingforce is to be applied between the arm and the plate, and the respective lengths of the arm and the plate.

Clip 10 may also include a hook 25 constituted by a horizontal member 26 extending outwardly from arm 13 and a vertical member 27 extending upwardly from the forward end thereof. A brace 28 beneath horizontal member 26 extending from arm 13 provides added support for the hook.

In addition to hook 25, plate 11, member 20 and arm 13 may together constitute a hook. Member 20 can support items hung therefrom and plate 11 and arm 13 will prevent them from slipping off rearwardly or forwardly.

Figure 4:
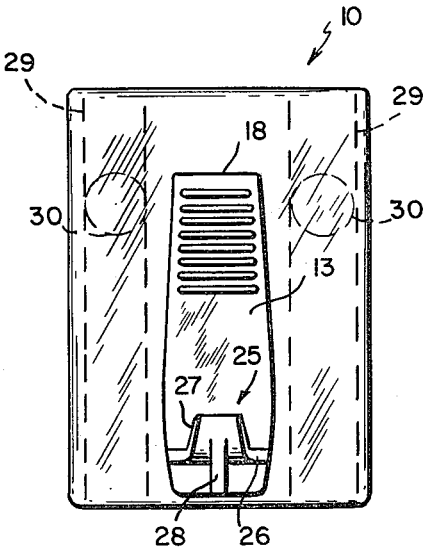
FIG. 4 is a front elevational view of the clip shown in FIG. 1.

Clip 10 may further include a pressure sensitive adhesive 29 on the rear surface of plate 11 by which the clip may be mounted on a wall or other vertical surface. The adhesive may, for example, be in two vertical strips along parallel edges of the plate. The strips may be situated vertically, as shown in FIG. 4, or horizontally. Alternatively, one or several adhesive strips may be provided in either direction. Furthermore, mechanical mounting means (not shown) may be used. For example, holes such as holes 30 shown in phantom lines in FIG. 4 may be provided in plate 11 to accommodate screws for fastening the clip to a wall.

The outer surface of arm 13 may be grooved as shown in the figures to prevent the user's finger from slipping.

In place of plate 11, clip 10 may be formed having a second arm (not shown).

As an alternative to stop 24, an indentation (not shown) may be formed in plate 11 to accept the free end 23 of member 20.

It will thus be seen from the foregoing that clip 10 can be readily molded and assembled in a simplified and inexpensive manner, all of the elements being provided in the one molded, easily assembled piece.

It is contemplated that those skilled in the art will readily make various changes to and improvements in the above constructions without departing from the spirit and scope of the invention. Accordingly, it is intended that all matter named in the above description and shown in the accompanying drawing be interpreted as illustrative and not in a limiting sense, and that the invention be limited only as defined in the following claims and equivalents thereto.

What is claimed as new and desired to be secured by Letters Patent of the United States is:

1. A clip comprising:

a pair of opposing jaws;

first and second support means, each having a first end attached to one of said jaws, and a second end distal to said jaw;

means for coupling together said first and second support means in a pivotal connection to permit them to pivot with respect to each other; and an elongated member of resilient material pivotally attached to the distal end of one of said support means, said elongated member being adapted to be disposed between said support means in a U-shaped curve such that the closed end of the U-shaped curve is directed toward said coupling means and the open end of the U-shaped curve is directed toward the distal ends of the support means, whereby the elongated member abuts the respective first and second support means when disposed therebetween to urge said distal ends apart an urge said jaws together.

2. A clip as defined in claim 1 wherein at least one of the support means comprises an arm.

3. A clip as defined in claim 1 wherein at least one of the support means comprises a plate.

4. A clip as defined in claim 1 wherein the first and second support means coupling means comprises a resilient web extending between the first and second support means.

5. A clip as defined in claim 1 wherein the elongated member is attached to the one of the support means through a resilient neck member.

6. A clip as defined in claim 1 wherein one of the support means further supports a hook extending outwardly therefrom.

7. A clip as defined in claim 1 wherein one of the support means further includes means for facilitating mounting said clip on a support surface.

8. A clip as defined in claim 7 in which said mounting means constitutes pressure sensitive adhesive.

9. A clip as defined in claim 7 in which said mounting means constitutes means defining a hole adapted to accommodate fastening means.

* * * * *